US005197241A

United States Patent [19]

Romeo et al.

[11] Patent Number: 5,197,241

[45] Date of Patent: Mar. 30, 1993

[54] GAZEBO TOP CONNECTION

[75] Inventors: Ernest A. Romeo, Healdsburg; Tyrell T. Gilb, Berkeley, both of Calif.

[73] Assignee: Simpson Strong-Tie Company, Inc., San Leandro, Calif.

[21] Appl. No.: 808,217

[22] Filed: Dec. 16, 1991

[51] Int. Cl.[5] ..... E04B 1/347

[52] U.S. Cl. ..... 52/82; 52/86; 52/63; 52/80; 403/232.1

[58] Field of Search ..... 403/232.1, 217, 171, 403/176, 170; 52/90, 82, 712, 714, 715, 80, 63

[56] References Cited

U.S. PATENT DOCUMENTS

| | | | |
|---|---|---|---|
| 3,481,635 | 12/1969 | Tracy | 403/232.1 |
| 4,092,809 | 6/1978 | Bellas et al. | 52/86 |
| 4,426,814 | 1/1984 | Stuhmer | 52/82 |

OTHER PUBLICATIONS

Copy of advertisement, Kant-Sag Starplate (trademark) connector offer.

*Primary Examiner*—Carl D. Friedman
*Assistant Examiner*—Wynn E. Wood
*Attorney, Agent, or Firm*—James R. Cypher

[57] ABSTRACT

A gazebo top connection which includes a gazebo top connector formed from a single sheet metal piece, the upper ends of a plurality of wood rafters and fasteners joining the gazebo top connector and the wood rafters. The gazebo top connector is formed with arms which are field bendable to accommodate rafters at infinite pitches over a wide range of roof pitches. A compression ring formed in the gazebo top connector provides a connection which gives strength to the connection.

5 Claims, 4 Drawing Sheets

GAZEBO TOP CONNECTION

BACKGROUND OF THE INVENTION

This invention relates to a connection of the upper ends of a plurality of rafters in a gazebo. A gazebo as defined herein is a turret shaped building structure constructed on either the roof of a house or it may be a free standing structure usually found in a garden or a park setting.

Specifically, this invention relates to a gazebo top connector made from a single sheet metal piece which connects the upper portions of a plurality of wood rafters which form the structure for the roof of the gazebo.

Gazebos are generally 4 to 8 sided structures with 5 and 6 sides being the most common form. A five or six sided structure creates a problem in joining the rafters at their upper ends. Joining the top ends of the rafters with nails results in time consuming precise angle (generally 120°) bevel cuts and a weak joint due to splitting of the wood unless the nailing is very precisely executed. Both of these are problems for the "do-it-yourselfer" weekend carpenter.

A commercial connector for gazebo rafters is on the market which is constructed from a single metal member and stamped to form indentations for the receipt of rafters. The prior art connector is not field bendable to accommodate rafters of different pitch and requires bolts and nuts to make the rafter connection. This requires the factory to manufacture and distributors to carry a large supply of connectors which differ so as to accommodate gazebos having different roof pitches.

The prior art connector is suitable only for connection to the bottom of the rafters which may result in an aesthetically unpleasant construction or one that is structurally inadequate.

SUMMARY OF THE INVENTION

The gazebo top connection of the present invention provides a structurally sound connection for the top ends of a plurality of wood rafters used in constructing the roof of a gazebo.

The invention includes a single piece gazebo top connector which not only serves to securely connect the rafters to one another, but also serves as a jig so that the top ends of the rafters are evenly radially spaced and form a uniformly even polyhedral shape.

The single piece gazebo top connector may be fastened to the wood rafters with either nails or screws.

An important feature of the present invention is the fact that the same gazebo top connector can be field bent by the craftsman so that the same gazebo top connector may be used in connecting rafters having different pitches. Thus, the same gazebo top connector can be used for either making a gazebo having a steep pitch roof or a shallow pitch roof as well as all pitch angles therebetween.

Another feature is the fact that a gazebo may be constructed in which the roof of the gazebo may contain rafters of different pitch by merely field bending the arms of the gazebo top connector to different angles.

A still further advantage of the present invention is the fact that a gazebo top connector of identical design may be placed beneath the rafters and used to connect the bottom edges of the rafters, or it may be placed on top of the rafters and used to connect the top edges of the rafters.

In an alternate form of the invention, the gazebo top connection may consist of two gazebo top connectors with one being placed on top of the rafters and the other beneath the rafters. This form of the invention provides an unusually strong connection.

One of the arms is shown in two alternate positions to illustrate that all of the arms of both the first and second gazebo top connectors can be field bent by a workman to accommodate an infinite number of angles. The 30° angles indicated are for illustrative purposes only.

Figure 3:
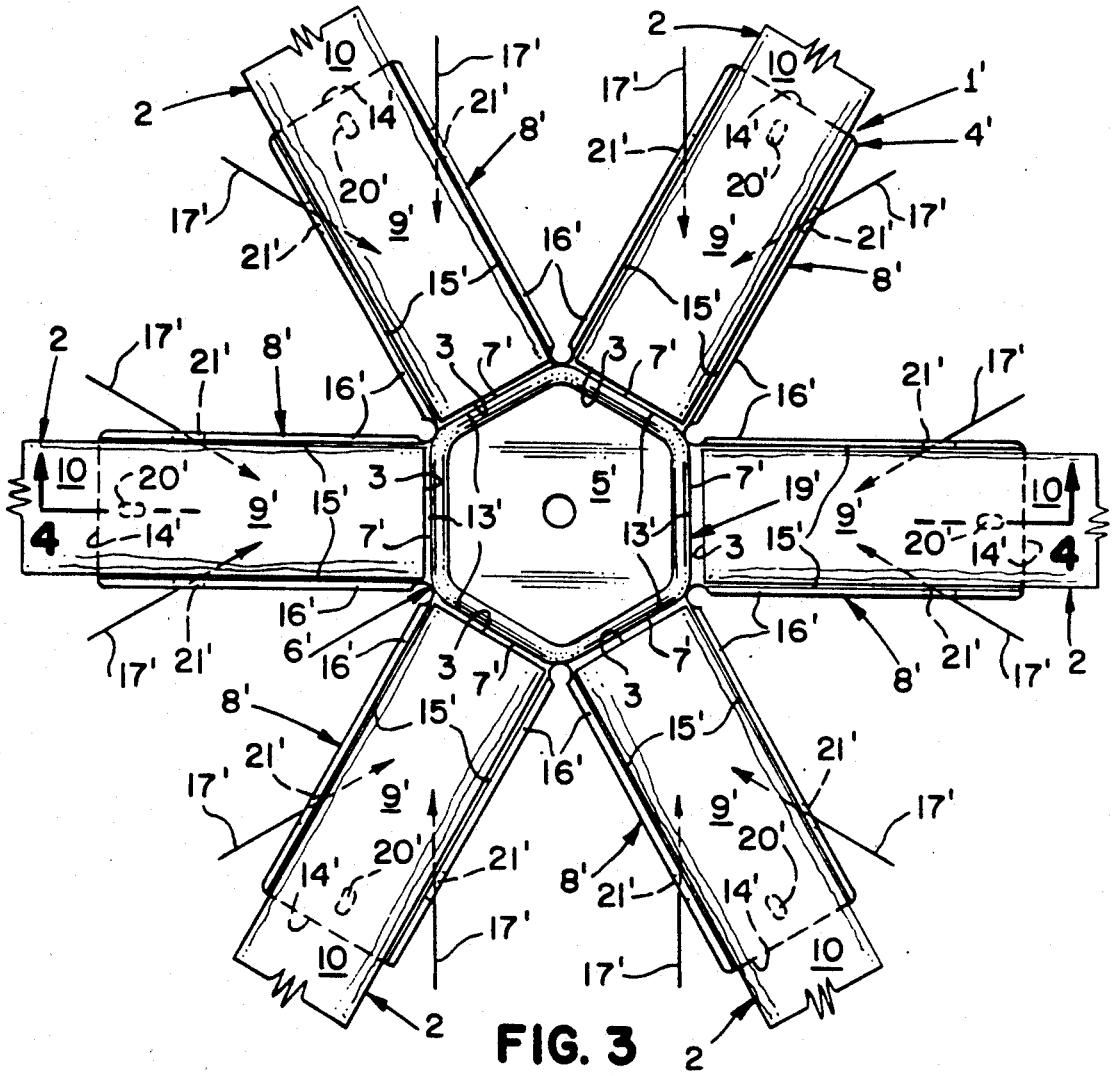
FIG. 3 is a bottom plan view of the gazebo top connection of the present invention illustrating the second gazebo top connector in an unbent position and portions of the wood rafters.
Figure 5:
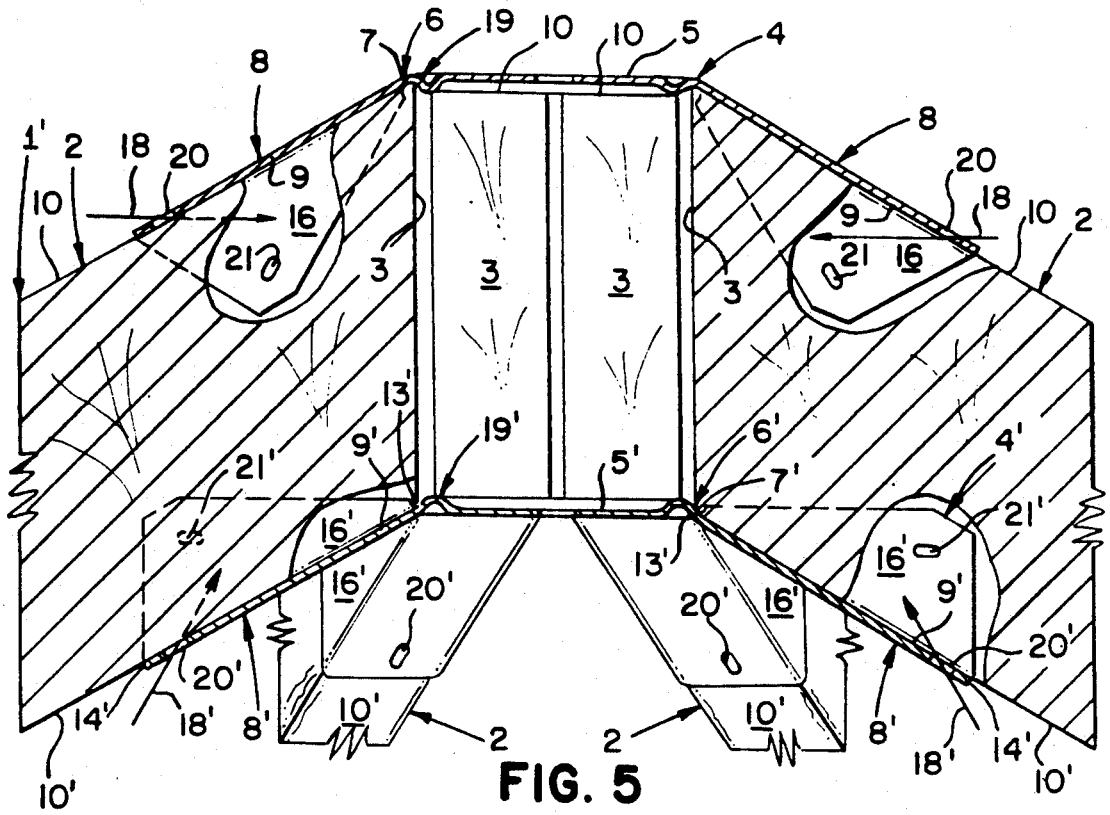

FIG. 5 is a cross sectional view of the gazebo top connection of the present invention taken along line 4—4 of FIG. 3. Both of the gazebo top connectors are shown in a bent position. Portions of the wood rafters are illustrated.

Figure 1:
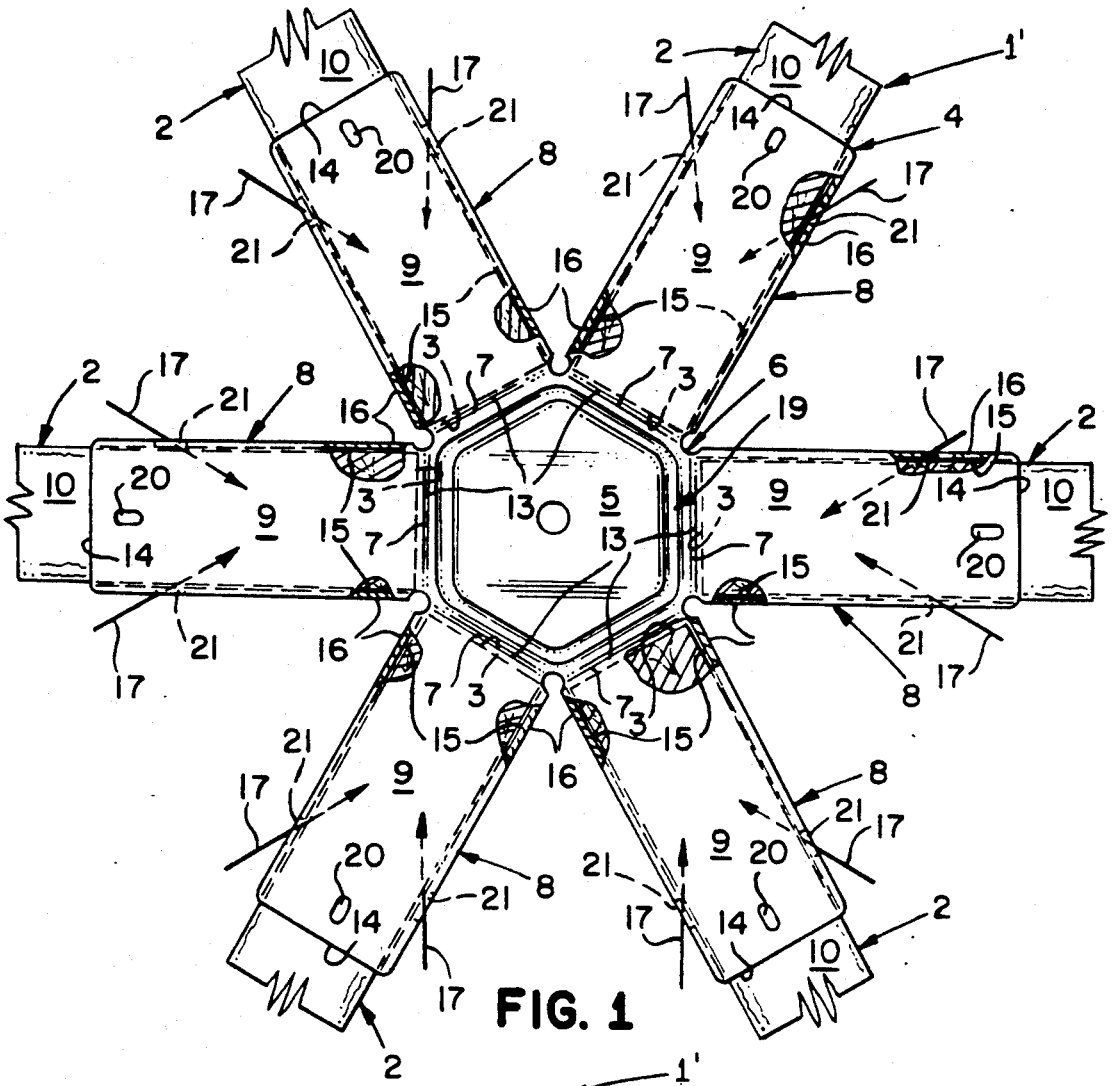
FIG. 1 is a top plan view of the gazebo top connection of the present invention illustrating the first gazebo top connector in an unbent position and portions of the wood rafters.
Figure 2:
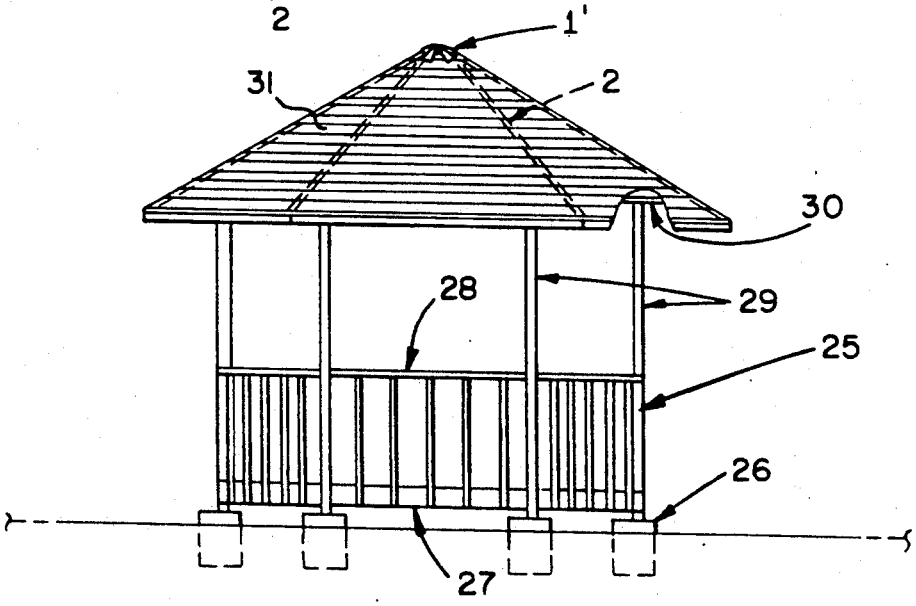
FIG. 2 is an elevation view of a gazebo with a gazebo top connection of the present invention installed at the roof peak.
Figure 6:
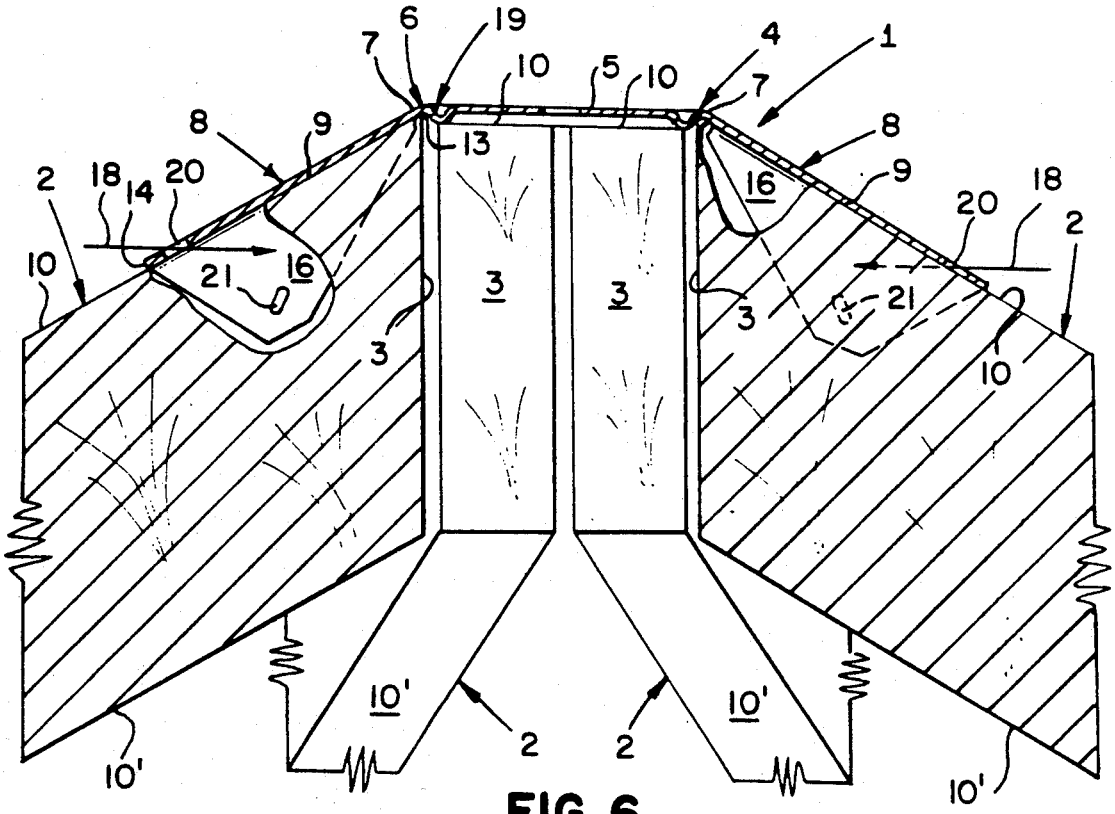

FIG. 6 is a cross sectional view of an alternate form of the invention illustrating a gazebo top connection having only a single gazebo top connector such as the first gazebo top connector illustrated in FIG. 1. The gazebo top connection illustrated in FIG. 6 is illustrated as though the cross section was taken along line 4—4 of FIG. 3 but with the second gazebo top connection removed.

Figure 7:
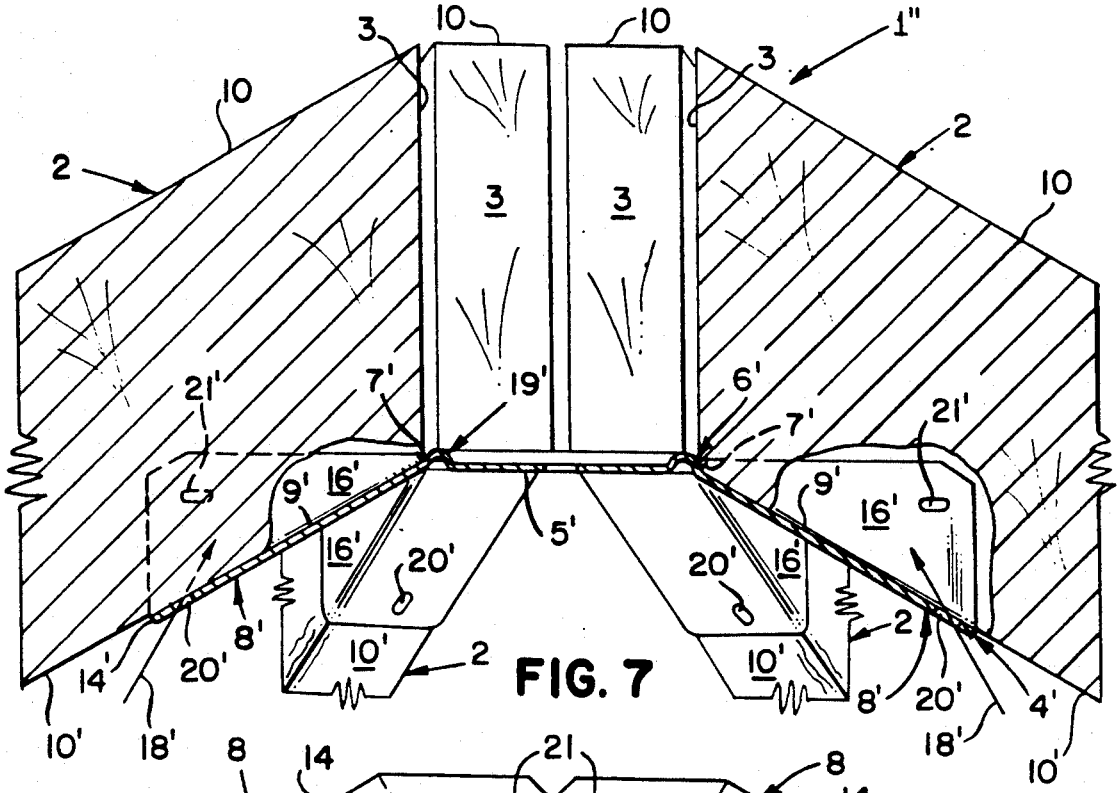

FIG. 7 is a cross sectional view of another alternate form of the invention illustrating a gazebo top connection having only a single gazebo top connector such as the second gazebo top connector illustrated in FIG. 3. The gazebo top connection illustrated in FIG. 7 is illustrated as though the cross section was taken along line 4—4 of FIG. 3 but with the first gazebo top connection removed.

Figure 8:
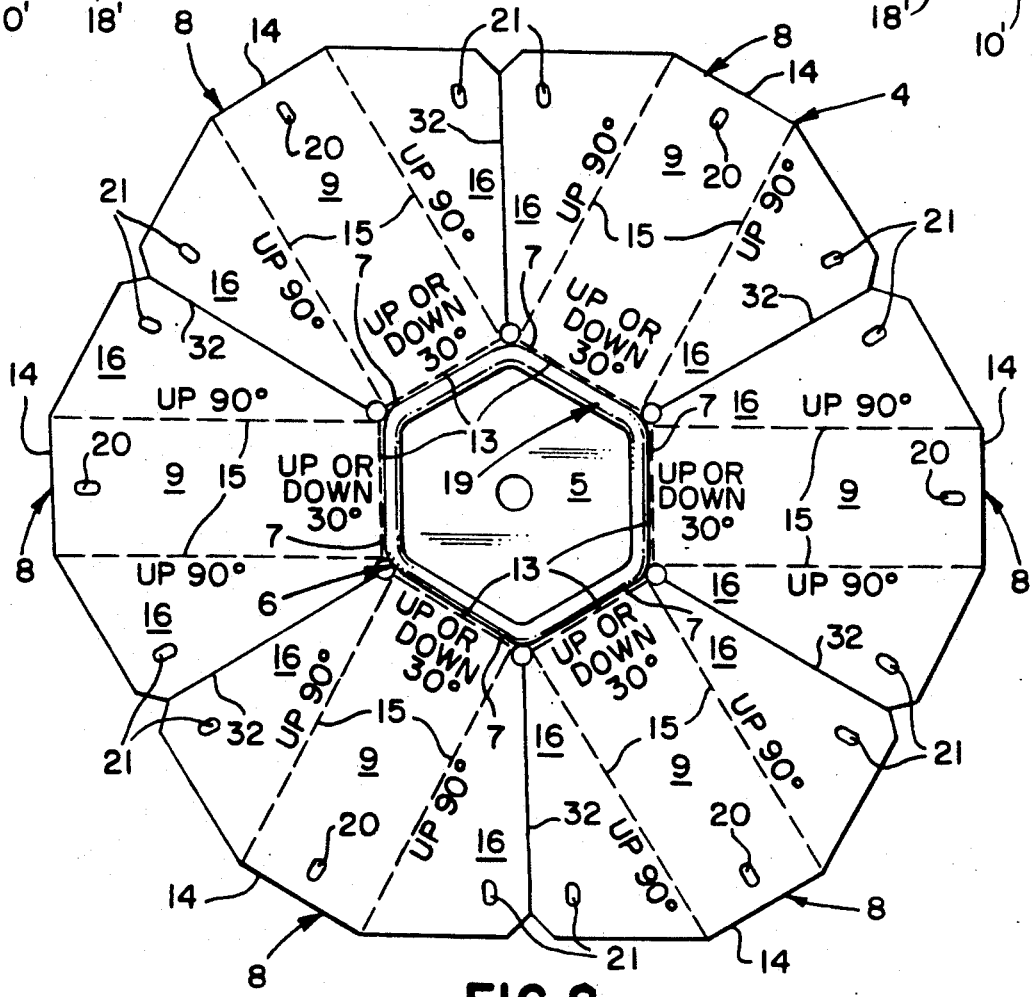

FIG. 8 is a plan view of a blank which has been cut and scored, but not yet bent which may be used to make either the first gazebo top connector illustrated in FIG. 1 or the second gazebo top connector illustrated in FIG. 3.

DESCRIPTION OF THE PREFERRED EMBODIMENT

Referring to FIGS. 6, and 8, the gazebo top connection 1 of the present invention consists of a plurality of wood rafters 2 having upper and lower edges 10 and 10' and opposed sides 12 inclined and radially disposed and having upper ends 3 arranged in close association; a first gazebo top connector 4 constructed from sheet metal and including: a hub member 5 having a perimeter 6 formed by multiple generally straight bend line edges 7; a plurality of arms 8 radiating from the hub member 5 connected to the hub member 5 only along the straight bend line edges 7 permitting field bending of the plurality of arms 8 angularly to the hub member 5; each of the plurality of arms 8 are formed with an elongated seat member 9 having a width selected for receiving an upper edge 10 of one of the wood rafters 2, a proximal end 13 connected only to the hub member 5 along one of the bend lines 7, a distal end 14 disposed from the proximal end 13, lateral side edges 15, and first and second side flanges 16 integrally attached to the lateral side edges of the seat member 9 and extending at generally right angles to the seat member 9 and dimensioned for registration with opposite sides 12 of one of the wood rafters 2; a first plurality of side flange fasteners indicated by arrows 17 attaching each of the wood rafters 2 to each of the first and second side flange members 16., and a first plurality of seat fasteners 18 attaching each of the wood rafters 2 to each of the seat members 9.

To maximize the strength of the gazebo top connection 1 the hub member 5 of the gazebo top connector 4 is formed with a compression ring member 19 along the entire perimeter 6 of the hub member 5.

A preferred way of constructing the compression ring member 19 is to form it as a multi-sided embossment in the hub member 5.

Where the gazebo top connection is to be assembled by a workman using nails and a hammer or screw fasteners and a screw gun, each of the first and second side flanges 16 are preferably formed with at least one side fastener opening 21 for receipt of the side flange fasteners 17 therethrough; and each of the seat members 9 is formed with at least one seat fastener opening 20 for receipt of the seat fasteners therethrough.

In some instances an even stronger gazebo top connection 1' is desired; parts of which are illustrated in FIGS. 1, 2, 3, 4, 5, and 8. In such cases a second gazebo top connector 4' is provided which is identical to the gazebo top connector 4 previously described. Since all parts are identical, further description is not required. The drawing is marked so that identical parts of the second gazebo top connector 4' are marked with a prime (') mark. The first and second gazebo top connectors 4 and 4' are disposed on opposite sides of the upper ends of the wood rafters 2 and a second plurality of side flange fasteners 17' are used in attaching each of the wood rafters 2 respectively to each of the first and second side flanges 16' of the second gazebo top connector 4'; and a second plurality of seat fasteners 18' are used for attaching each of the lower edges 10' of wood rafters 2 respectively to each of the seat members 9' of the second gazebo top connector 4'.

Figure 4:
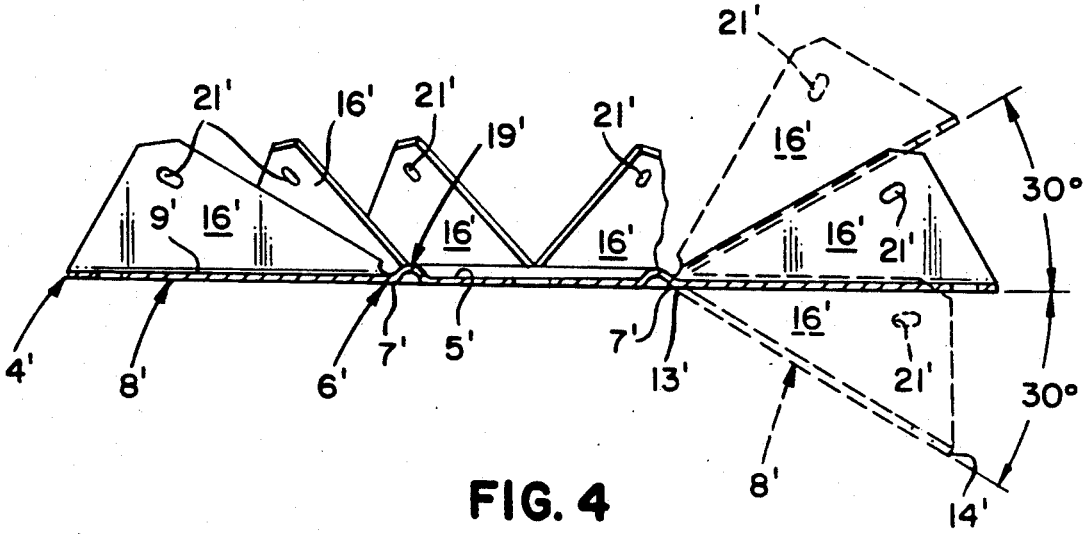
FIG. 4 is an elevational cross sectional view of the second gazebo top connector only taken along line 4—4 in FIG. 3.

FIGS. 4 and 7, illustrate another alternate form of the gazebo top connection 1'' invention in which a single gazebo top connector 4' is attached to the undersides 10' of the rafters 2. Gazebo top connector 4' is identical to gazebo top connector 4 previously described and the description need not be repeated. As shown in FIGS. 4 and 7, arms 8' are bent downwardly along straight line edges 7' instead of upwardly.

The gazebo top connection 1, 1', or 1'' of the present invention may be used for a gazebo constructed on top of a house, but is most commonly used presently for the construction of a gazebo 25 located in a home or public garden as illustrated in the drawings. Such a gazebo 25 commonly is constructed with a foundation 26, a floor 27, railing 28, support posts 29, which support top plates 30 upon which the lower ends of the wood rafters 2 rest, and roofing material 31 attached to the wood rafters.

As an example, the gazebo top connectors 4 and 4' may be constructed from 18 gauge galvanized sheet metal. The blank is approximately 10.7" in diameter before bending with the arms 8 approximately 3.78" long and the seat widths 1.56". The hub member 5 is approximately 2.5" at its widest part and the compression ring member 19 is embossed to a depth of approximately 0.250" with an approximate width of $\frac{3}{8}$".

Fastener openings are slots 0.25"×0.1719" and nails or screw fasteners may be used to secure the roof rafters which may be 2"×4" or 2"×6". Preferably the fasteners are inserted through the fastener openings 20, 20', 21, and 21' at a slant angle for greater holding power.

Compression ring member 19 and 19' in addition to strengthening the first and second gazebo top connectors 4 and 4' also serves as a stop which retains the upper ends 3 of wood rafters 2. This serves to place all of the rafters in generally equal compression.

Referring to FIG. 8, in constructing the first gazebo top connector 4 from the blank, the sheet metal is cut along solid cut lines 32 and bent upwardly 90° along dashed lines 15. The arms 8 are bent in the field along straight line edges 7.

We claim:

1. A gazebo top connection comprising:

a. at least three wood rafters having upper and lower edges and opposed sides inclined and radially disposed and having upper ends arranged in close association and their longitudinal axes substantially intersecting a common point;

b. a first gazebo top connector constructed from a single element sheet metal member and including:

(1) a hub member having a perimeter formed by multiple generally straight bend line edges and formed with a compression ring member along said entire perimeter of said hub member;

(2) at least three arms radiating from said hub member connected to said hub member only along said straight bend line edges permitting field bending of said plurality of arms angularly to said hub member;

(3) each of said arms are formed with an elongated seat member having a width selected for receiving said upper edge of one of said wood rafters, a proximal end connected only to said hub member along one of said bend lines, a distal end disposed from said proximal end, lateral side edges, and first and second side flanges integrally attached to said lateral side edges of said seat member and extending at generally right angles to said seat member and dimensioned for registration with said opposed sides of one of said wood rafters;

c. a first plurality of side flange fasteners attaching each of said wood rafters to each of said first and second side flange members; and d. a first plurality of seat fasteners attaching each of said wood rafters to each of said seat members.

2. A gazebo top connection as set forth in claim 1 wherein:

a. said compression ring member is formed as a multi-sided embossment in said hub member.

3. A gazebo top connection as set forth in claim 2 wherein:

a. each of said first and second side flanges are formed with at least one side fastener opening for receipt of said side flange fasteners therethrough; and b. each of said seat members is formed with at least one seat fastener opening for receipt of said seat fasteners therethrough.

4. A gazebo top connection as defined in claim 1 comprising:

a. a second gazebo top connector as defined in claim 1 wherein said first and second gazebo top connectors are disposed on opposite sides of said upper ends of said wood rafters;

b. a second plurality of side flange fasteners attaching each of said wood rafters respectively to each of said first and second side flanges of said second gazebo top connector; and c. a second plurality of seat fasteners attaching each of said wood rafters respectively to each of said seat members of said second gazebo top connector.

5. A gazebo connection comprising:

a. at least three wood rafters having upper and lower edges and opposed sides inclined and radially disposed and having upper ends arranged in close association and their longitudinal axes substantially intersecting a common point;

b. a second gazebo top connector constructed from a single element sheet metal member and including:

(1) a hub member having a perimeter formed by multiple generally straight bend line edges and formed with a compression ring member said entire perimeter of said hub member;

(2) at least three arms radiating from said hub member connected to said hub member only along said straight bend line edges permitting field bending of said plurality of arms angularly to said hub member;

(3) each of said arms are formed with an elongated seat member having a width selected for receiving said lower edge of one of said wood rafters, a proximal end connected only to said hub member along one of said bend lines, a distal end disposed from said proximal end, lateral side edges, and first and second side flanges integrally attached to said lateral side edges of said seat member and extending at generally right angles to said seat member and dimensioned for registration with said opposed sides of one of said wood rafters;

c. a second plurality of side flange fasteners attaching each of said wood rafters to each of said first and second side flange members; and d. a second plurality of seat fasteners attaching each of said wood rafters to each of said seat members.

* * * * *